United States Patent [19]

Shen

[11] Patent Number: 4,840,412

[45] Date of Patent: Jun. 20, 1989

[54] EASILY ADJUSTABLE LATCH

[76] Inventor: Richard Shen, No. 233, Sec. 2, Hai Tien Road, Tainan, Taiwan

[21] Appl. No.: 83,823

[22] Filed: Aug. 11, 1987

[51] Int. Cl.[4] ..... E05C 1/16

[52] U.S. Cl. ..... 292/337; 292/DIG. 60

[58] Field of Search ..... 292/337, 1, DIG. 38, 292/DIG. 60, 169.13, 169, 169.22, 169.23

[56] References Cited

U.S. PATENT DOCUMENTS

| | | | |
|---|---|---|---|
| 3,819,214 | 6/1974 | Hart et al. | 292/DIG. 38 X |
| 4,664,433 | 5/1987 | Solovieff | 292/DIG. 60 X |
| 4,718,706 | 1/1988 | Fang | 292/337 |
| 4,729,585 | 3/1988 | Lin | 292/337 |
| 4,729,586 | 3/1988 | Fang | 292/337 |
| 4,736,973 | 4/1988 | Fang | 292/337 |
| 4,752,090 | 6/1988 | Lin | 292/DIG. 60 X |

*Primary Examiner*—Richard E. Moore

*Attorney, Agent, or Firm*—Morton J. Rosenberg

[57] ABSTRACT

A latch including inner and outer cylindrical housings, the inner housing having a guide slot thereon for receiving a guide piece and fixing the slide path of the outer housing with respect to the inner housing. The inner housing has a protuberance which is engageable with a minimum or a maximum backset hole. A retainer plate having two retainer posts fits into the inner housing. The retainer post receives springs for loading a main bolt and an auxiliary bolt. A link and a slide bar can be used according to whether minimum or maximum backset is required. A stabilizer also prevents the auxiliary bolt from being forced open from the outside.

1 Claim, 4 Drawing Sheets

EASILY ADJUSTABLE LATCH

BACKGROUND OF THE INVENTION

This invention relates to a door latch (lockset) and in particular relates to a door latch with an adjustable backset. In the past, door latches either did not have adjustable backset or the backset was adjustable, but only with the aid of tools, or was only adjustable by those skilled in the art of door latch installation.

It is the purpose of this present invention, therefore, to mitigate and/or obviate the above-mentioned drawbacks in the manner set forth in the detailed description of the preferred embodiment.

SUMMARY OF THE INVENTION

A primary objective of this invention is to provide an adjustable backset latch which can be adjusted without the aid of special tools or skills.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figures 1A, 1B:
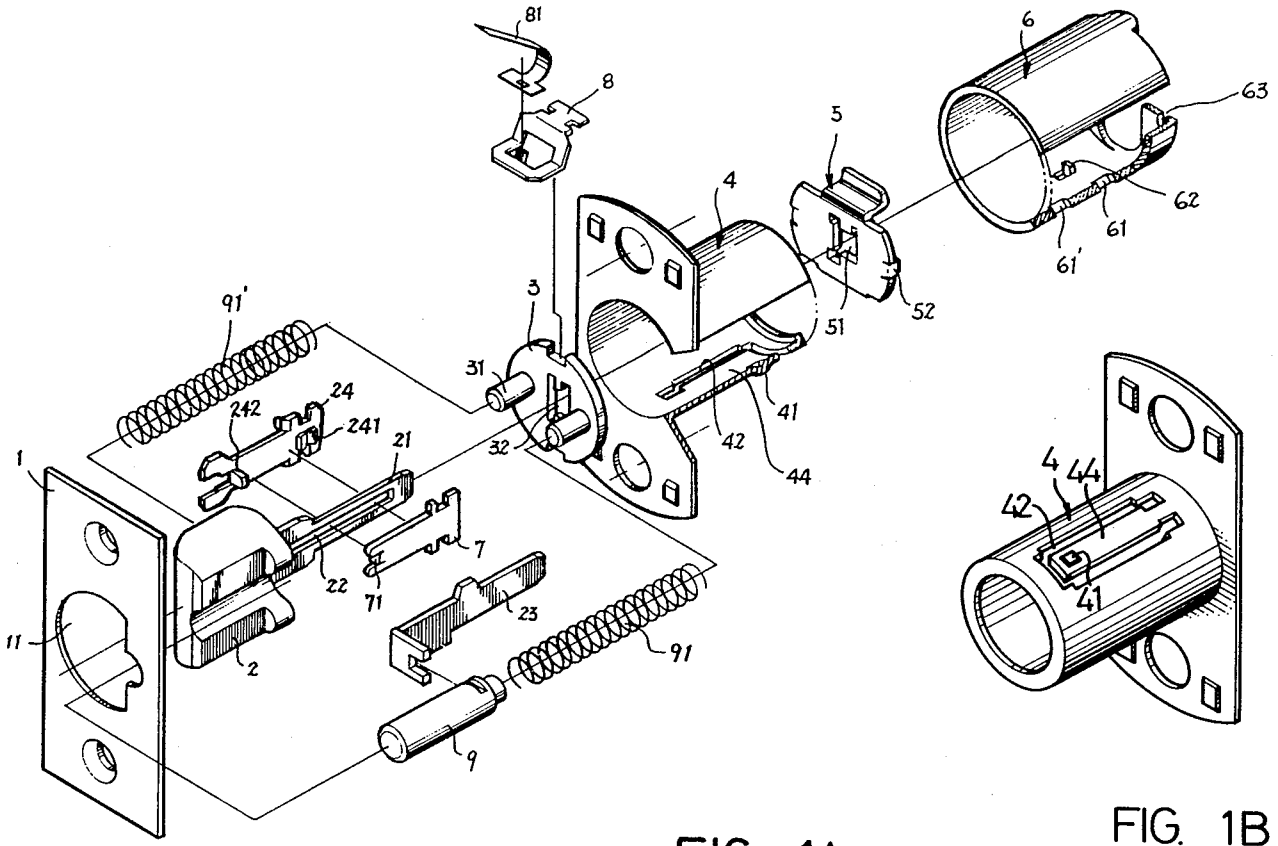
FIG. 1A is an exploded view of an easily adjustable variable latch in accordance with the present invention.
FIG. 1B is a perspective view of the lower portion of the inner housing showing the V-shaped guide slot.

Referring to FIG. 1, it can be seen that the present invention comprises a substantially cylindrical inner housing 4, a substantially cylindrical outer housing 6, a main bolt 2 and an auxiliary bolt 9 which are extendable through a bolt opening 11 in a faceplate 1. The rear side of the main bolt 2 has a slide extension 21 projecting rearwardly from the rear end thereof with an extension slot 22 set horizontally along a center axis thereof. A link 24 and a slide bar 7 are slidable in said extension slot 22. The link 24 has a stop 242 on one end thereof and a punchout 241 on the other end thereof, both facing towards and slidably fitting into the slide extension 21. The punchout 241 secures the link 24 in the extension slot 22. The slide bar 7 also has a catch 71 which is slidably retained in the extension slot 22. The catch is not only retained by the extension slot 22, but also is restricted to horizontal sliding motion between the stop 242 and the punchout 241 of the link 24.

The main bolt 2 and the auxiliary bolt 9 are spring-loaded by springs 91 and 91′, respectively, to be in a normally extended position. The auxiliary bolt 9 is secured to and urgeable by an L-shaped actuating plate 23 which engages on a rear end thereof. Since the auxiliary bolt, in and of itself, uses conventional techniques and structure, it will not be further discussed herein. The springs themselves, 91 and 91′, are received and loaded on respective retainer posts 31 of a retainer plate 3. These springs, 91 and 91′ provide restoring force for the main bolt 2 and the auxiliary bolt 9, respectively. The retainer plate 3 is retained by the circular retention wall 43 of an inner housing 4, which also comprises a plate portion. The cylindrical part of the inner housing 4 also has a substantially U-shaped guide slot 42 thereon and a small protuberance 41 projecting radially outwards from a central point of a cutout section, 44 formed by the guide slot 42. Since the guide slot 42 forms a partial cutout around the protuberance 41, the cutout section 44 is flexible and can be easily urged inwards by a small normal force applied by the user. This feature will be discussed further at a later point in the specification.

An outer housing 6 telescopes over the inner housing 4 and has a guide piece 62 projecting inwards so as to be received in the guide slot 42 of the inner housing 4. The guide slot 42 controls the motion of the guide piece 62 and hence controls the motion of the outer housing 6. An end plate 5 fits into the rear end of the outer housing 6 and is fixed thereon by fixing grips 52, which fit into fixing holes 63.

Figure 3:
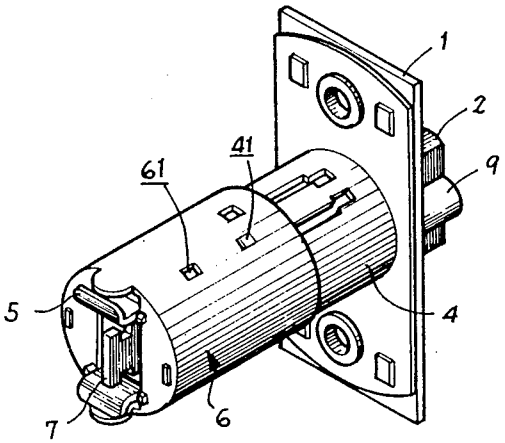
FIG. 3 is the same as FIG. 2, except in maximum backset position.
Figure 2:
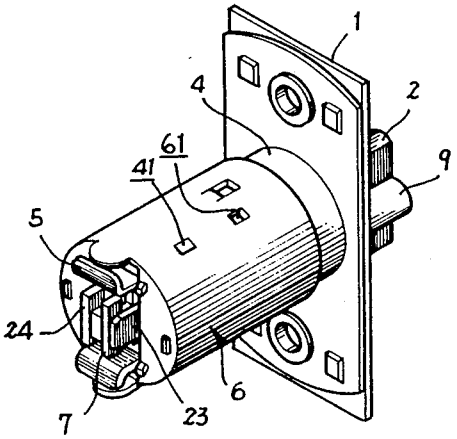
FIG. 2 is a perspective view of a variable latch in accordance with the present invention in minimum backset position.

From FIG. 2 and 3, the two basic positions of the present invention can be seen. The first position, seen in FIG. 2, is for a minimum backset (preferably $2\frac{3}{8}''$). The second position, shown in FIG. 3, is for a maximum backset (preferably $2\frac{3}{4}''$).

Still referring to FIG. 2 and 3, it can be seen that in minimum backset position that the protuberance 41 of the inner housing 4 fits into the minimum backset hole 61, at the rear of the outer housing 6, and in maximum backset position the protuberance fits into the maximum backset hole 61′, near the front of the outer housing 6. In minimum backset position, the link 24, the slide bar 7 and the L-shaped actuating plate 23 all project outwards from the end of the outer housing 6. In maximum backset position, only the slide bar 7, which is slidable in the extension slot 22 (see FIG. 1) projects from the end of the outer housing 6. So it can be understood that in minimum backset position the spindle of a doorknob (not shown) would urge both the link 24 and the slide bar 7. When the variable backset latch in the maximum backset position, only the slide bar 7 is extended through the hole in the end plate 5 and urged by the spindle of the doorknob handle (spindle and doorknob not shown) to retract said slide extension 12 and bolt 12.

Figure 4:
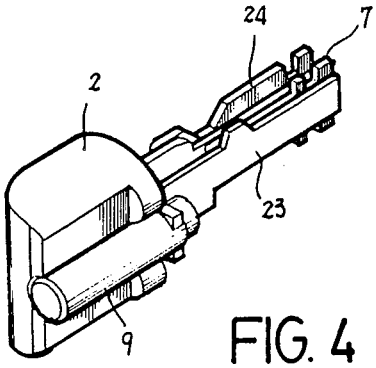
FIG. 4 is a perspective view of the main and auxiliary bolt, with the auxilary bolt in extended condition.
Figure 5:
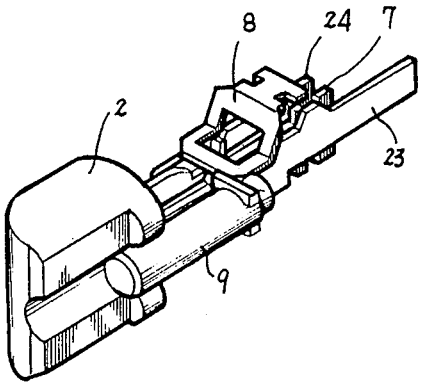
FIG. 5 is a perspective view of the main and auxiliary bolt, with the auxiliary bolt retracted.
Figure 6:
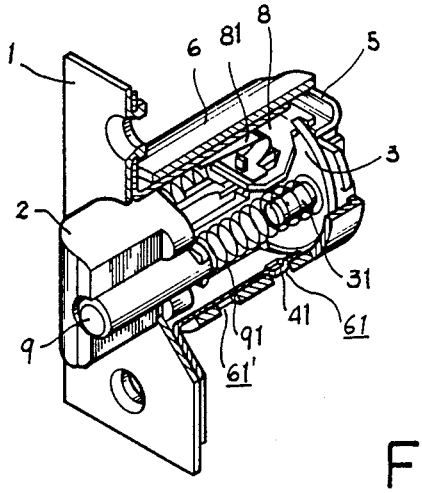
FIG. 6 is a partially cut away view of a latch according to the present invention, in minimum backset position.

Referring to FIGS. 4–6, some of the unique internal operations of the variable backset latch of the present invention can be seen for minimum backset position. The stabilizer 8, which has a bent O-shape, prevents the auxiliary bolt 9 from being urged out of its corresponding semi-circular recess in the main bolt 2. In other words, the stabilizer 8 prevents the auxiliary bolt from being forced open as shown in FIG. 5. This feature provides added safety against forced entry of the lock. In FIG. 6, it can be seen that the rearmost end of the stabilizer 8 has two recesses which engage with the retainer plate 3 so as to secure the stabilizer horizontally in the inner housing 4. A flat spring 81 can also be seen, the top end of which contacts the inner well of the inner housing 4 and the lower end of which has a hole which engages with a small protrusion on the stabilizer 8 so as to vertically secure the stabilizer 8. FIG. 6 shows the protuberance 41 in the minimum backset hole 61. Should the user wish to change the backset distance from minimum backset (2¾") to maximum backset (2¾"), he simply slides the outer housing 6 rearwardly so that the protuberance 41 engages with the maximum backset hole 61'. It should be noted that the protuberance 41 "springs" back into the backset holes due to the flexibility and elasticity of the cutout section 44 that the protuberance 41 is on. In essence, the protuberance and its corresponding U-shaped plate act as a flat spring.

Figure 7:
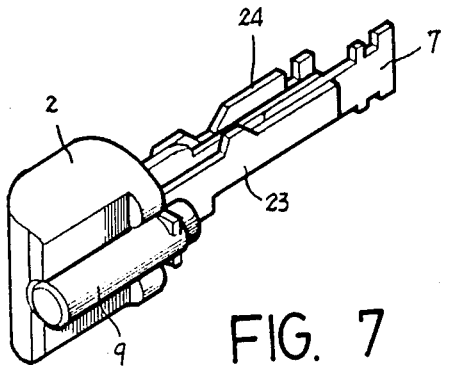
FIG. 7 is a view similar to FIG. 4 but in maximum backset position with the slide bar 7 extended.
Figure 8:
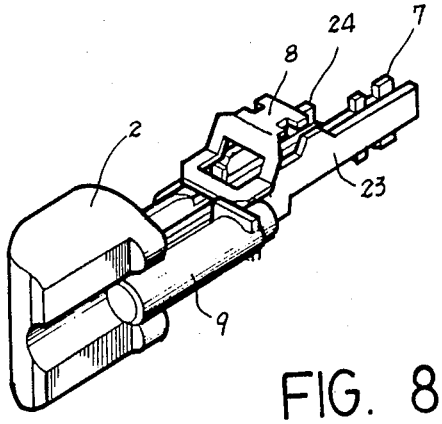
FIG. 8 is a view similar to FIG. 5 but in maximum backset position, with the slide bar extended.
Figure 9:
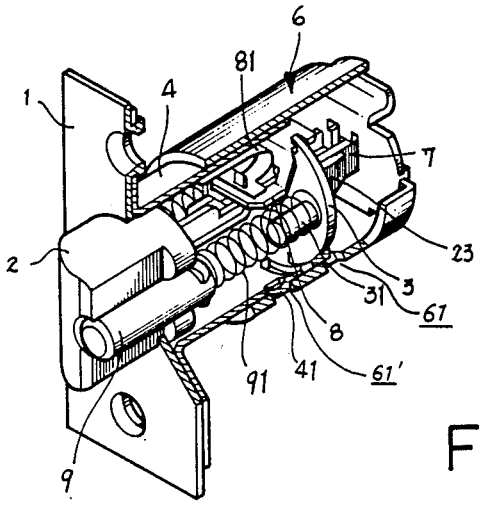
FIG. 9 is a view similar to FIG. 6, but in maximum backset position.

FIGS. 7–9 are substantially the same as FIG. 4–6, except that the variable backset latch of the present invention is in maximum backset position (i.e. the spindle only urges the slide bar 7). In this position the protuberance 41 engages with the foremost or maximum backset hole.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. An easily adjustable variable backset latch comprising:

(A) a substantially cylindrical inner housing (4) with a U-shaped guide slot (42) and a protuberance (41) thereon; said protuberance (41) projecting radially outwards from a central point of a cut out section (44) formed by said guide slot (42); said inner housing (4) also having a plate portion on a foremost end thereof which is fixed to a faceplate (1);

(B) a main bolt (2) having a slide extension (21) projecting rearwardly from a rear end thereof; said slide extension (21) having an extension slot (22) set horizontally along a center axis thereof; a link (24) being on a first side of said extension slot (22) and being slidably secured thereto by means of a punchout (241) and a stop (242); a slide bar (7) being on a second side of said extension slot (22), said slide bar (7) being slidably retained in said extension slot (22) by a catch (71), and said catch (71) being slidable between said stop (242) and said punchout (241), said slide bar (7) being urgeable by a spindle of a doorknob handle to retract said slide extension (21) and said main bolt (2) when said variable backset latch is in maximum backset position;

(C) an auxiliary bolt (9) which is secured to and urgeable by an L-shaped actuating plate (23);

(D) a retainer plate (3) with two retainer posts (31) thereon; said retainer plate (3) being retained by a circular retention wall (43) of said inner housing (4); said two retainer posts (31) respectively receiving springs (91, 91') thereon for providing a restoring force for the main bolt (2) and the auxiliary bolt (9), respectively; a bent O-shaped stabilizer (8) having two recesses at one end thereof to engage with and secure the retainer plate (3) and having a protrusion on another end thereof, said stabilizer (8) preventing said auxiliary bolt (9) from being forced open; a flat spring (81) with a hole on a first end thereof for receiving said protrusion on said stabilizer (8) so as to vertically secure said stabilizer (8), with a second end of said stabilizer (8) contacting an inner wall of said inner housing (4); and (E) a substantially cylindrical outer housing (6) having a guide piece (62) for engaging with said guide slot (42); said outer housing (6) also having a minimum backset hole (61) and a maximum backset hole (61'); said protuberance (41) being engageable with either of said backset holes (61 or 61').

* * * * *